US005240029A

United States Patent [19]

Ludewig

[11] Patent Number: 5,240,029

[45] Date of Patent: Aug. 31, 1993

[54] HOSE-TYPE FAUCET WITH BACKFLOW PREVENTER

[75] Inventor: Hans J. Ludewig, Rinteln, Fed. Rep. of Germany

[73] Assignee: Friedrich Grohe Aktiengesellschaft, Hemer, Fed. Rep. of Germany

[21] Appl. No.: 830,123

[22] Filed: Jan. 31, 1992

[30] Foreign Application Priority Data

Feb. 20, 1991 [DE] Fed. Rep. of Germany ..... 4105175

[51] Int. Cl.[5] ..... E03C 1/10

[52] U.S. Cl. ..... 137/217; 137/218; 4/675

[58] Field of Search ..... 137/215, 216, 217, 218, 137/302; 4/675

[56] References Cited

U.S. PATENT DOCUMENTS

| | | | |
|---|---|---|---|
| 1,954,105 | 4/1934 | Stoddard | 137/216 X |
| 2,250,291 | 7/1941 | Boosey | 137/216 |
| 3,730,209 | 5/1973 | Binard et al. | 137/217 |
| 5,079,781 | 1/1992 | Gnauert et al. | 137/218 X |

FOREIGN PATENT DOCUMENTS 3708169 9/1988 Fed. Rep. of Germany .

*Primary Examiner*—John C. Fox

*Attorney, Agent, or Firm*—Herbert Dubno; Andrew Wilford

[57] ABSTRACT

A backflow preventer used in combination with a valve that normally supplies water under pressure to a feed conduit and with an outlet device having a supply hose to which water is normally supplied under pressure has a housing forming a generally closed chamber and formed with an inlet port connected with the feed conduit and opening into the chamber, an outlet port connected to the hose and opening into the chamber directly underneath the inlet port, and a vent port having an outside exposed to ambient air and forming substantially the only direct passage between the chamber and an ambient atmosphere around the housing. A check valve in the vent port only permits flow through the port into the chamber so that air can be drawn into the chamber through the vent port when pressure in the chamber is below ambient pressure. A nozzle fitted to the inlet port directed downward along a vertical axis into the outlet port forms therewith a jet pump for transferring water from the inlet port to the outlet port.

9 Claims, 2 Drawing Sheets

HOSE-TYPE FAUCET WITH BACKFLOW PREVENTER

FIELD OF THE INVENTION

The present invention relates to a backflow preventer. More particularly this invention concerns such a preventer used in a hose-type faucet system, that is a faucet that includes a sprayer hose that may itself form the faucet head.

BACKGROUND OF THE INVENTION

In order to make it impossible, for example, for a hose-type sprayer to take in any unclean water if its head it left immersed after the water supply is shut off, it is known from U.S. Pat. No. 4,827,538 to provide the mixing valve with a vent fitting that admits air to the mixing chamber of the valve. Such a fitting is provided in a passage extending between the mixing chamber and the surroundings and basically comprises a very sensitive check valve that permits flow inward into the valve when the pressure inside the valve is slightly less than the outside pressure, as low as 3 cm to 5 cm water column. Thus when the water is shut off the siphon effect of the water in the faucet or hose will cause this vent valve to open so that air is admitted to the mixing chamber and the fitting can drain. During normal use when the mixing chamber is pressurized, the vent valve is tightly closed. Thus if some underpressure is created in the supply lines, dirty water is not sucked back into the valve.

This arrangement has the disadvantage that it increases the size of the mixing valve, which normally is mounted atop the deck next to the sink or basin. Since the appearance of this item is critical, anything that increases its size constitutes a severe design problem.

A plumbing fitting is described in German patent document 3,805,462 filed 22 Feb. 1988 by W. Gnauert and published 31 Aug. 1989. It has a pressurizable chamber and is formed with a vent passage opening at an inner end into the chamber and at an outer end to ambient-pressure surroundings. A vent assembly comprises an inner check valve in the passage having an inner side exposed to pressure in the chamber and an outer side turned away therefrom and an outer check valve in the passage between the inner valve and the outer passage end and having an outer side exposed to the ambient pressure of the surroundings and an inner side turned away therefrom and forming with the passage and outer side of the inner valve a normally closed compartment. Each valve opens when pressure on its outer side exceeds that on its inner side and closes when pressure on its inner side exceeds that on its outer side.

Another such arrangement is described in German patent document 3,708,169 of K. Gute wherein a backflow preventer has a housing formed with an inlet port connected to pressurizable supply line, an outlet port connected to the outlet device serviced by the system, and a vent port. An accordion-like extension of the inlet port can reach into the outlet port when pressurized to connect the inlet and outlet ports together and cut out the vent port, but when depressurized it breaks the direct connection between the inlet and outlet ports and permits the inlet port to draw in through the vent port.

Both such systems can be located out of sight, but have a limited effectiveness but are susceptible of improvement.

OBJECTS OF THE INVENTION

It is therefore an object of the present invention to provide an improved backflow preventer.

Another object is the provision of such an improved backflow preventer which overcomes the above-given disadvantages, that is which operate surely and safely, which are of simple foolproof construction, and which can be located out of sight below the level of the basin being serviced.

SUMMARY OF THE INVENTION

The instant invention is a backflow preventer used in combination with a valve that normally supplies water under pressure to a feed conduit and with an outlet device having a supply hose to which water is normally supplied under pressure. It has a housing forming a generally closed chamber and formed with an inlet port connected with the feed conduit and opening into the chamber, an outlet port connected to the hose and opening into the chamber directly underneath the inlet port, and a vent port having an outside exposed to ambient air and forming substantially the only direct passage between the chamber and an ambient atmosphere around the housing. A check valve in the vent port only permits flow through the port into the chamber so that air can be drawn into the chamber through the vent port when pressure in the chamber is below ambient pressure. A nozzle fitted to the inlet port directed downward along a vertical axis into the outlet port forms therewith a jet pump for transferring water from the inlet port to the outlet port.

This system is extremely simple and effective. Any water that backs or spatters into the housing collects on its floor and is sucked out the outlet port by jet-pump action. Nonetheless if there is a momentary pressure reversal in the upstream supply conduit, air will be sucked in through the vent and there will be no drawback from the outlet device. No flow back out of the vent port is possible due to the check valve. Instead if there is some back pressure on the outlet hose, the only effect will be a sliqht buildup of air pressure in the chamber of the housing with, at worst, a small amount of backup water collecting on the floor of the housing.

The system is used with a basin fillable by the outlet device to a predetermined highest possible level and the vent port is adjacent the inlet port and provided with a conduit extension having an outer end above the level. The housing has a top wall formed with the vent port, thus this vent port is above the outlet port and generally level with the inlet port.

Furthermore according to the invention a booster funnel in the housing has a large-diameter upstream end into which the nozzle opens and a small-diameter downstream end directed into the outlet port. The inlet port, outlet port, nozzle, and booster funnel are all centered on the axis. In addition the housing has a predetermined cross-sectional width equal to about five times the diameter of the inlet port and the housing has a vertical height equal to about seven and one-half times this diameter.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
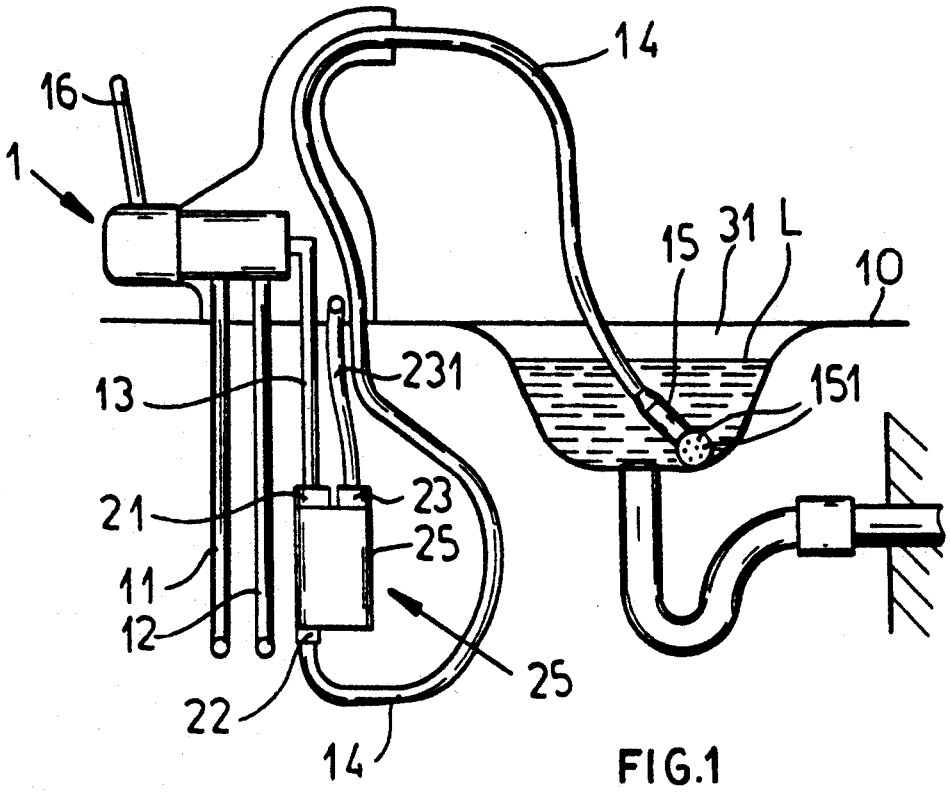
FIG. 1 is a largely schematic view of the system of this invention.
Figure 2:
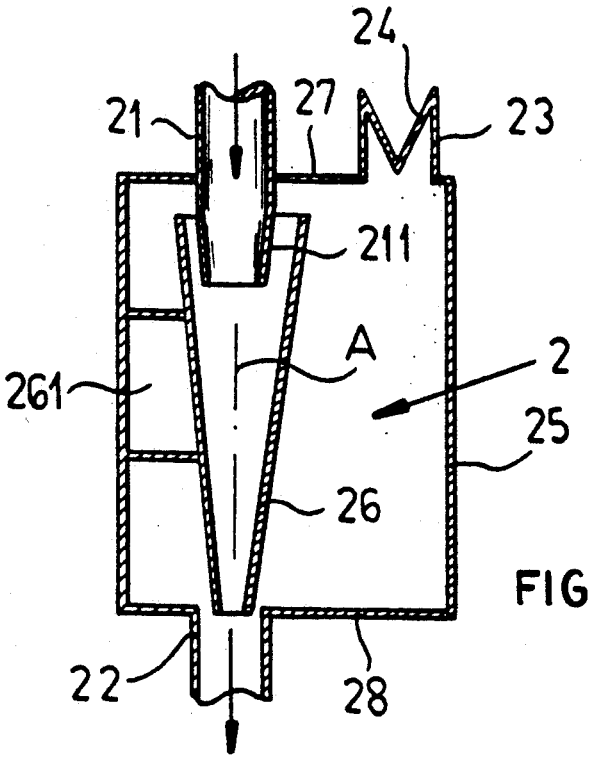
FIG. 2 is a vertical section through the backflow preventer of FIG. 1.

As seen in FIGS. 1 and 2 a valve 1 mounted on a deck 10 adjacent a sink or basin 31 is supplied with hot and cold water via riser pipes 11 and 12 and feeds it in turn, according to the position of a lever 16, to a supply line 13 that projects back down through the deck 10. A backflow preventer 2 underneath the deck 10 is connected to this line 13 and to a hose 14 that extends up through the deck and to an outlet fitting 15 having holes 151. Thus water at a temperature and pressure determined by the position of the valve handle 16 is fed through the preventer 2 to the outlet device 15, to exit therefrom via the holes 151 into the basin 3.

As seen in FIG. 2 the preventer 2 has a can-like housing 25 having a top wall 27 formed with an inlet port 21 extended as a jet-pump nozzle 211 and connected to the supply line 13, and a bottom wall 28 formed with an outlet port 22 connected to the hose 14. In addition the top wall 27 is formed With an inlet port 23 provided with a check valve 24 and extended via a conduit 231 up to a level at the deck 10 above the highest possible liquid level L of liquid in the basin 31. The valve 24 can be of the mitral or duckbill type with a plurality of soft flaps that part readily to allow air flow into the can 25 but that effectively prevent any flow therefrom.

The jet-pump nozzle 211 formed at the inlet port 21 extends slightly down into the upper large-diameter end of a frustoconical booster funnel 26 whose small-diameter lower end is level with and directed along an axis A into the outlet port 22. Struts 261 support the funnel 26 in the housing 25. Thus the pressurized stream that exits from the restricted downstream end of the nozzle 211 will enter the booster funnel 26 and exit again as a pressurized small-diameter stream to enter the outlet port 22, which obviously is of larger flow cross section than the lower funnel end. The result is, in effect a two-stage jet-pump action.

Under normal circumstances flow will be fairly direct from the inlet 21 to the outlet 22 and thence along the hose 14 to the outlet device 15. If flow to the inlet port 21 is stopped and the spray head 15 is left a illustrated in FIG. 1 below the surface L in the basin 31, an siphon-action back flow into the housing 25 will at worst cause a tiny amount of water to collect on the housing floor 28. The next time the line 21 is pressurized, this backflow water will be drawn out immediately.

If due to some upstream anomaly, pressure in the supply line 13 drops below ambient pressure, the interior of the housing 25 will be briefly subjected to subatmospheric pressure and the valve 24 will open, allowing the line 21 to draw air in through the vent 23.

Figure 3:
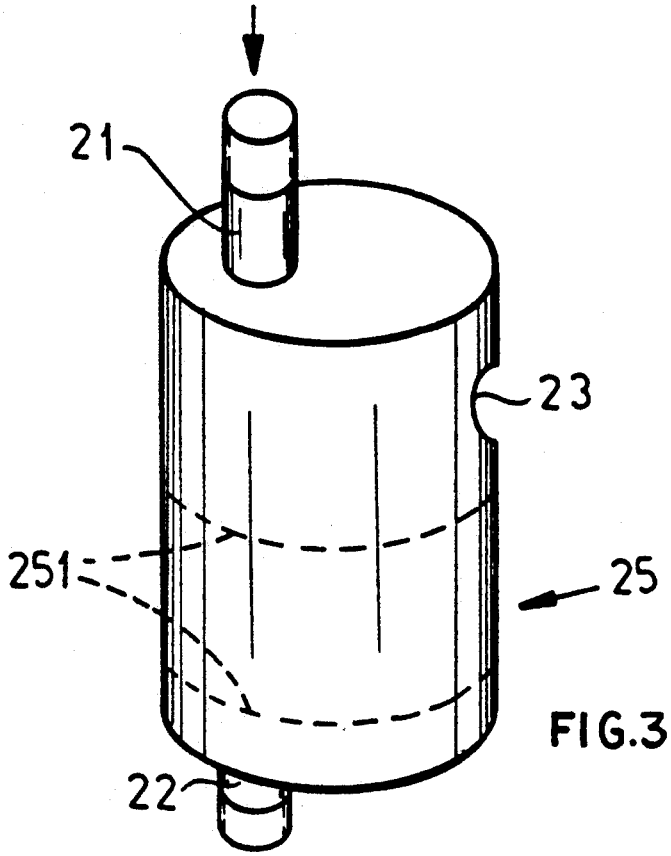
FIGS. 3 and 4 are perspective and vertical sectional views through another backflow preventer according to the invention.
Figure 4:
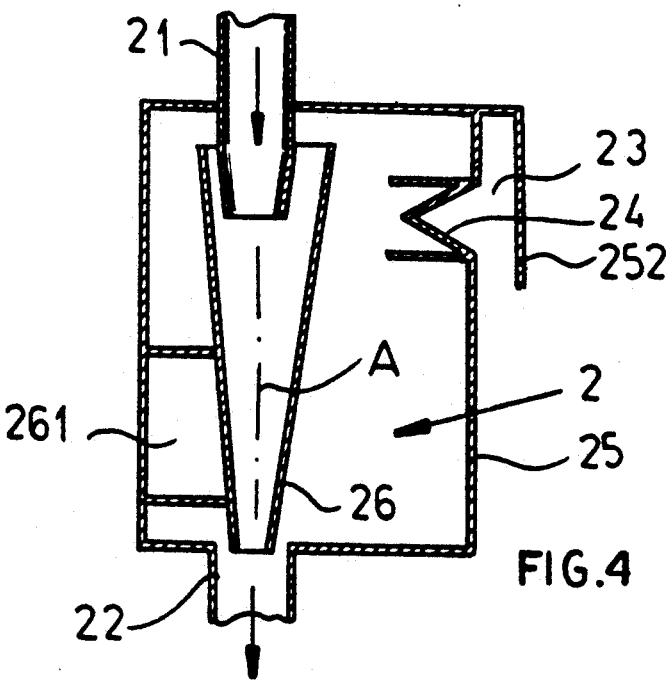

In the arrangement of FIGS. 3 and 4 the can is shown to be cylindrical with two seams 251 at which its parts are joined. Furthermore it has a height equal to about seven and one-half times the diameter of the inlet port 21 and a diameter equal to about five times the inlet-port diameter.

Furthermore in this arrangement the vent port 23 is formed in an upper region of the side wall and is protected by a depending skirt or shield 252. Nonetheless the port 23 is well above the port 22.

I claim:

1. In combination with a valve that normally supplies water under pressure to a feed conduit and with an outlet device having a supply hose to which water is normally supplied under pressure, a backflow preventer comprising:

a housing forming a generally closed chamber and formed with an inlet port connected with the feed conduit and opening into the chamber, an inlet port connected to the hose and opening into the chamber directly underneath the inlet port, and a vent port having an outside exposed to ambient air and forming substantially the only direct passage between the chamber and an ambient atmosphere around the housing;

a check valve in the vent port only permitting flow through the port into the chamber, whereby air can be drawn into the chamber through the vent port when pressure in the chamber is below ambient pressure; and means including a booster funnel having a large-diameter upwardly open upstream end underneath the inlet port and a small-diameter downstream end directed into the outlet port, and a nozzle fitted to the inlet port and directed downward along a vertical axis into the upstream end of the funnel and forming therewith a jet pump for transferring water from the inlet port to the outlet port.

2. The backlfow preventer defined in claim 1 wherein the combination further includes a basin fillable by the outlet device to a predetermined highest possible level, the vent port being adjacent the inlet port and provided with a conduit extension having an outer end above the level.

3. The backflow preventer defined in claim 1 wherein the housing has a top wall formed with the vent port.

4. The backflow preventer defined in claim 1 wherein the inlet port, outlet port, nozzle, and booster funnel are all centered on the axis.

5. The backflow preventer defined in claim 1 wherein the check valve is of the membrane-lip duckbill type.

6. The backflow preventer defined in claim 1 wherein the housing has a top wall provided with the inlet port, a parallel bottom wall provided with the outlet port, and a side wall interconnecting the top and bottom walls.

7. The backflow preventer defined in claim 6 wherein the inlet port has a predetermined diameter, the housing has a predetermined cross-sectional width equal to about five times the diameter, and the housing has a vertical height equal to about seven and one-half times the diameter.

8. The backflow preventer defined in claim 6 wherein the side wall is formed of an upper part and a lower part joined together at an intermediate seam.

9. In combination with a valve that normally supplies water under pressure to a feed conduit and with an outlet device having a supply hose to which water is normally supplied under pressure, a backflow preventer comprising:

a housing forming a generally closed chamber and formed with an inlet port connected with the feed conduit and opening into the chamber, an outlet port connected to the hose and opening into the chamber directly underneath the inlet port, and a vent port having an outside exposed to ambient air and forming substantially the only direct passage between the chamber and an ambient atmosphere around the housing;

a check valve in the vent port only permitting flow through the port into the chamber, whereby air can be drawn into the chamber through the vent port when pressure in the chamber is below ambient pressure;

a booster funnel having a large-diameter upwardly open upstream end underneath the inlet port and a small-diameter downstream end directed into the outlet port and defining therewith a gap open into the chamber; and a nozzle fitted to the inlet port, directed downward along a vertical axis into the upstream end of the funnel, defining therewith a gap open into the chamber, and forming with the funnel a jet pump for transferring water from the inlet port to the outlet port.

* * * * *